US006281796B1

(12) United States Patent
Canipe et al.

(10) Patent No.: US 6,281,796 B1
(45) Date of Patent: Aug. 28, 2001

(54) POINT-OF SALE READER AND ELECTRONIC ARTICLE SURVEILLANCE TAG DEACTIVATOR INTERFACE

(75) Inventors: Larry Canipe, Boca Raton; Marco Paez, Delray Beach, both of FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/430,435

(22) Filed: Oct. 29, 1999

(51) Int. Cl.[7] ..... G08B 13/14

(52) U.S. Cl. ..... 340/572.3; 340/572; 340/572.1; 340/572.2; 340/551

(58) Field of Search ..... 340/572.3, 572, 340/572.1, 572.2, 551

(56) References Cited

U.S. PATENT DOCUMENTS

| | | | | |
|---|---|---|---|---|
| 4,881,061 | | 11/1989 | Chambers | 340/568 |
| 5,059,951 | * | 10/1991 | Kaltner | 340/572 |
| 5,187,354 | * | 2/1993 | Bengtsson | 340/572 |
| 5,257,010 | * | 10/1993 | Rehder | 340/572 |
| 5,477,219 | | 12/1995 | Zarembo et al. | 340/572 |
| 5,589,820 | | 12/1996 | Robinson et al. | 340/572 |
| 5,748,085 | * | 5/1998 | Davis et al. | 340/572 |
| 5,814,799 | * | 9/1998 | Swart et al. | 340/572 |
| 5,979,758 | * | 11/1999 | Swart et al. | 235/383 |

FOREIGN PATENT DOCUMENTS

| | | | |
|---|---|---|---|
| 0355355 | 2/1990 | (EP) | G07G/1/00 |
| 2 669 756 A1 | 5/1992 | (FR) | G06K/9/18 |
| PCT/ZA99/00114 | 10/1999 | (WO) . | |
| 98/9918 | 10/1998 | (ZA) . | |

* cited by examiner

*Primary Examiner*—Jeffery Hofsass
*Assistant Examiner*—Hung Nguyen
(74) *Attorney, Agent, or Firm*—Rick F. Comoglio; Paul T. Kashimba

(57) ABSTRACT

A system to non-invasively interface a POS reader/scanner to an EAS tag deactivator is provided and includes a reader for reading indicia, such as a bar code, associated with an article. The system is non-invasive because the integrity of the POS reader is not violated by the interface. The POS reader generates a signal to indicate a successful read of the indicia associated with the article. A sensor senses the signal produced by the POS reader and generates an output signal. An EAS tag deactivator is connected to the sensor. The sensor output signal triggers the EAS tag deactivator, which will remain energized for a preselectable period of time to deactivate an EAS tag associated with the article.

10 Claims, 3 Drawing Sheets

POINT-OF SALE READER AND ELECTRONIC ARTICLE SURVEILLANCE TAG DEACTIVATOR INTERFACE

CROSS REFERENCES TO RELATED APPLICATIONS N/A

STATEMENT REGARDING FEDERALLY SPONSORED RESEARCH OR DEVELOPMENT N/A

BACKGROUND OF THE INVENTION

1. Field of the Invention

This invention relates to security systems to reduce theft of goods from retail stores.

2. Description of the Related Art

A commercially available system for inhibiting the theft of goods from retail stores uses an active electronic article surveillance (EAS) tag associated with each article, which triggers an alarm when entering an interrogation zone at the store exit. The EAS tag reacts to signals transmitted by EAS security devices positioned at the exits of the store. Upon being interrogated by a specific signal, the EAS tag is adapted to emit a signal that is detectable by an EAS receiver, which can then activate an alarm. An EAS tag deactivator can deactivate the EAS tag associated with the article. A deactivated EAS tag will not be detectable by the EAS receiver and will not activate an alarm.

When an article is sold, the associated EAS tag is deactivated so that the article can be removed from the store without triggering an alarm at the exits of the store. To prevent the EAS tag deactivator from being used to deactivate an EAS tag when the associated article has not been sold, and to reduce power consumption and use, the deactivator can be selectively energized. Typically, at the point-of-sale (POS), the sales clerk scans indicia, such as a bar code, associated with the article with a reader. Upon being scanned, the information about the article contained on the indicia is entered into the cash register to designate a sale. The clerk knows that the indicia have been properly read because the POS reader includes some type of feedback, such as an audible or visual signal. The feedback signal is not present until the indicia are correctly read. Once the indicia are read, if a store clerk must then manually energize the EAS tag deactivator, an additional step must be performed during the checkout procedure. Further, the clerk could be in collusion with the customer and deactivate the EAS tag without reading/scanning the article for a sale.

In order to prevent the above type of theft and to selectively and automatically energize the EAS tag deactivator, the POS reader, which is commonly called a scanner, and the EAS tag deactivator have been electrically interfaced such that the EAS tag deactivator is triggered by the successful read of the indicia associated with the article being purchased. To interface the POS reader/scanner to the EAS tag deactivator, an electrical connection is made from the reader/scanner to the EAS tag deactivator. However, because of the number of different types of POS reader/scanners and EAS tag deactivators commercially available, many different types of electrical interfaces are required. In addition, implementing an electrical connection to a commercial POS reader/scanner product can void the warranty from certain equipment manufacturers. Therefore, a flexible and non-intrusive interface between a POS reader/scanner and an EAS tag deactivator is needed.

BRIEF SUMMARY OF THE INVENTION

A system to non-invasively interface a POS reader/scanner to an EAS tag deactivator is provided and includes a reader for reading indicia, such as a bar code, associated with an article. The system is non-invasive because the integrity of the POS reader is not violated by the interface. The POS reader generates a signal to indicate a successful read of the indicia associated with the article. The signal generated by the POS reader can be acoustic, optical, vibration, or other signal. The acoustic signal can be, but is not limited to, a tone or beep from a speaker, piezoelectric transducer, or ultrasonic transducer. The optical signal can be, but is not limited to, an LED, lamp, or other optical device that will flash, change colors, or turn on or off as a result of a successful read of the indicia by the reader. The vibration signal can be from a scanning motor that is activated upon scanning, or other vibration such as from a piezoelectric transducer.

A sensor senses the signal produced by the POS reader and generates an output signal. The sensor can be a microphone, optical sensor, vibration, ultrasonic, or other sensor depending upon the signal generated by the POS reader.

An EAS tag deactivator is connected to the sensor and detects the output signal generated by the sensor. The sensor output signal triggers the EAS tag deactivator, which will remain energized for a preselectable period of time. The POS reader can read the indicia associated with the article, and the EAS tag deactivator will then deactivate the EAS tag associated with the article. Once the EAS tag is deactivated, the article can be removed from the store without activating an alarm when the article passes through a store exit.

Accordingly, it is an object of the present invention to provide a non-invasive interface between a POS reader and an EAS tag deactivator such that a successful read of indicia associated with an article will trigger the EAS tag deactivator to deactivate an EAS tag associated with the article.

It is a further object of the present invention to provide a non-invasive acoustic interface between a POS reader and an EAS tag deactivator.

It is still a further object of the present invention to provide a non-invasive optical interface between a POS reader and an EAS tag deactivator.

It is yet a further object of the present invention to provide a non-invasive vibration interface between a POS reader and an EAS tag deactivator.

Other objectives, advantages, and applications of the present invention will be made apparent by the following detailed description of the preferred embodiment of the invention.

DETAILED DESCRIPTION OF THE INVENTION

Figure 1:
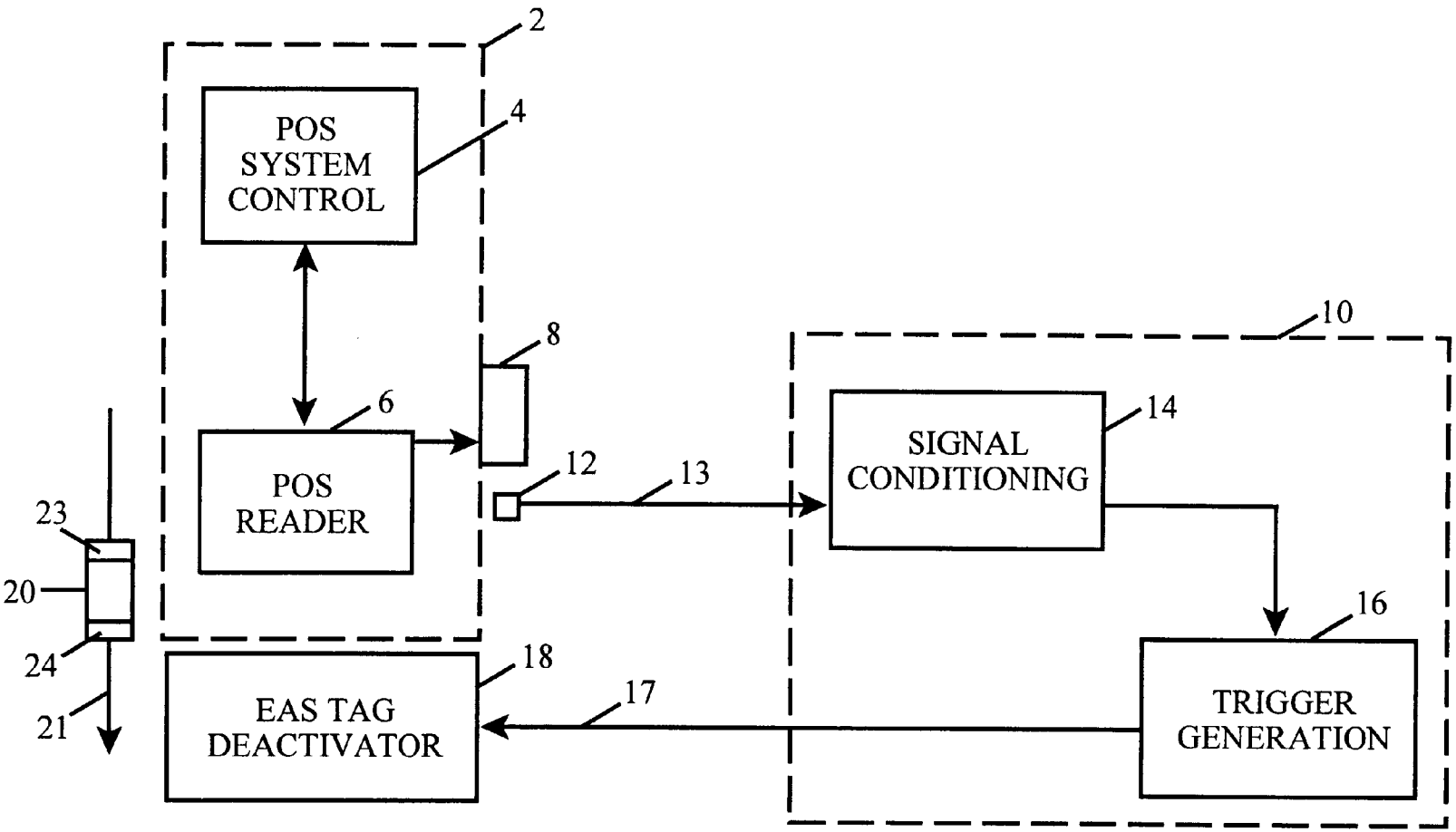
FIG. 1 is a block diagram of the present invention.

Referring to FIG. 1, conventional POS device 2 includes POS system control 4, POS reader 6, and POS reader indicator 8. Reader indicator 8 can be any device to indicate a successful read such as, but not limited to, an acoustic indicator, optical indicator, and/or a vibration indicator. The POS interface unit 10, includes POS indicator sensor 12, signal conditioning 14 for the sensor output signal 13 of indicator sensor 12, and trigger generation 16, which generates a trigger signal 17 in response to sensor output signal 13. Signal conditioning 14, as fully described hereinbelow, selectively recognizes the expected sensor output signal 13 of indicator sensor 12, and translates signal 13 to trigger generator 16 for generation of trigger signal 17.

EAS tag deactivator 18 is energized by the trigger signal 17 received from POS interface unit 10. Indicator sensor 12 senses the output of POS reader indicator 8 non-invasively. The connection of sensor output signal 13 of indicator sensor 12 to POS interface unit 10 can include, but is not limited to, cable, acoustic link, IR link, RF link, optical link, and other wire or wireless links.

In operation, an article 20 can be moved past POS reader 6, such as along the direction indicated by arrow 21. When POS reader 6 successfully reads indicia 23, indicator 8 is activated. The output of indicator 8 is sensed by indicator sensor 12. Indicator sensor 12 generates an output signal 13 after sensing indicator 8, which is used by POS interface unit 10 to generate trigger signal 17. Trigger signal 17 energizes EAS tag deactivator 18, which deactivates EAS tag 24. EAS tag deactivator 18 will remain energized for a preselected period of time. The time period of energization for EAS tag deactivator 18 will be selected to allow sufficient time for an operator to move article 20 from POS reader 6 to EAS tag deactivator 18 for deactivation of EAS tag 24. EAS tag deactivator 18 will turn off after the preselected period of time has expired to reduce power consumption and use, and to prevent deactivation of EAS tags 24 when no indicia 23 has been read by POS reader 6.

Indicator 8 can include an acoustic indication such as a speaker, piezoelectric transducer, ultrasonic transducer, or other device that produces acoustic signals. Indicator 8 can include an optical indication such as LEDs, lamps, or other optical devices that will flash, change colors, or turn on or off as a result of a successfull read of the indicia 23 by reader 6. Indicator 8 can also include vibration generation.

Figure 2:
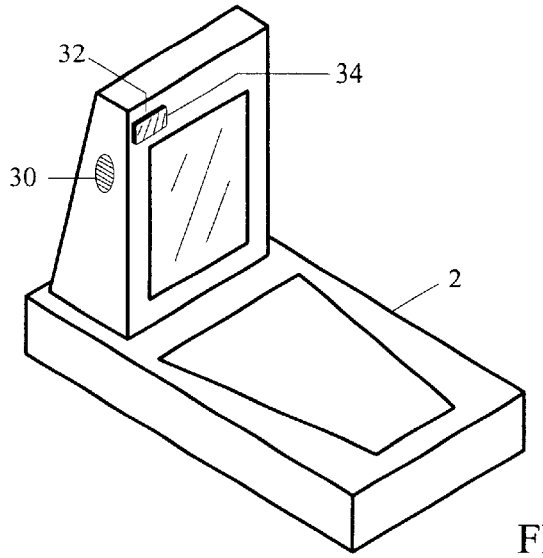
FIG. 2 is a schematic diagram of the present invention illustrating one placement for the POS indicator sensor.
Figure 3:
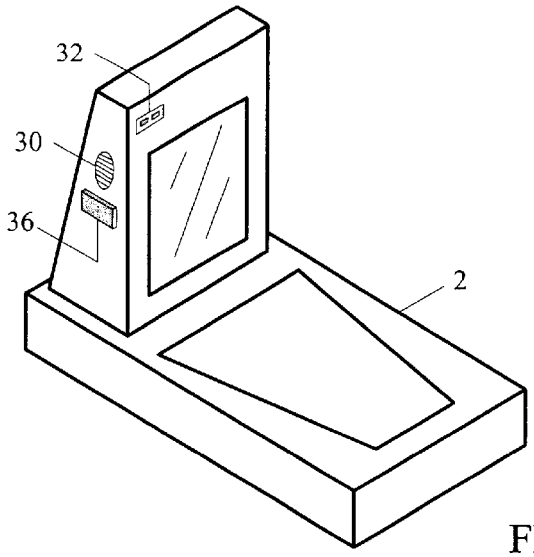
FIG. 3 is a schematic diagram of the present invention illustrating an alternate placement for the POS indicator sensor.
Figure 4:
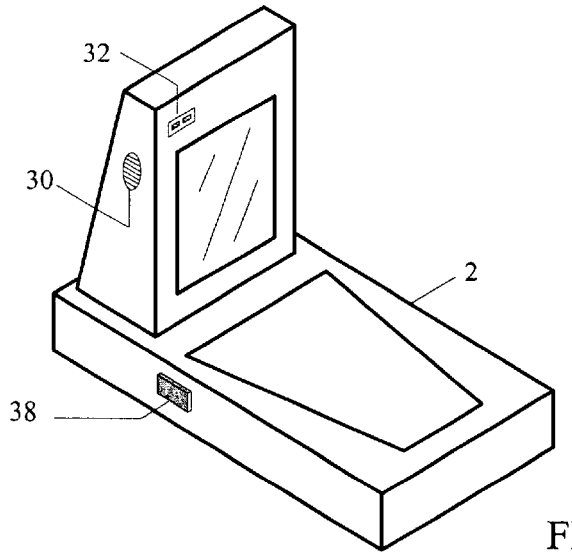
FIG. 4 is a schematic diagram of the present invention illustrating an alternate placement for the POS indicator sensor.

Referring to FIGS. 2, 3, and 4 three different placements for POS indicator sensor 12 are illustrated. POS device 2 has POS reader indicators 8, which consist of acoustic indicator 30 such as a piezoelectric transducer, ultrasonic transducer, and/or a speaker, optical indicator 32 such as LEDs and/or lamps, and vibration indicator (not separately shown). POS device 2 in FIGS. 2, 3, and 4 illustrate placement of optical sensor 34, microphone 36, and vibration sensor 38, respectively. Optical sensor 34 can sense LEDs, lamps, or other optical indicators that flash, change colors, or turn on or off depending on the output of optical indicator 32. Optical sensor 34 is placed in a suitable position near optical indicator 32. Microphone 36 is placed within sensing distance of acoustic indicator 30. Vibration sensor 38 can be an accelerometer that will sense mechanical vibrations caused by an internal scan motor (not shown) or by mechanical vibration generated by acoustic indicator 30. Vibration sensor 38 is suitably mounted on the POS device to sense mechanical vibration as described above. Sensing vibration from a scan motor can be used to enable and disable the EAS tag deactivator during periods of POS device operation or non-operation, respectively.

Figure 5:
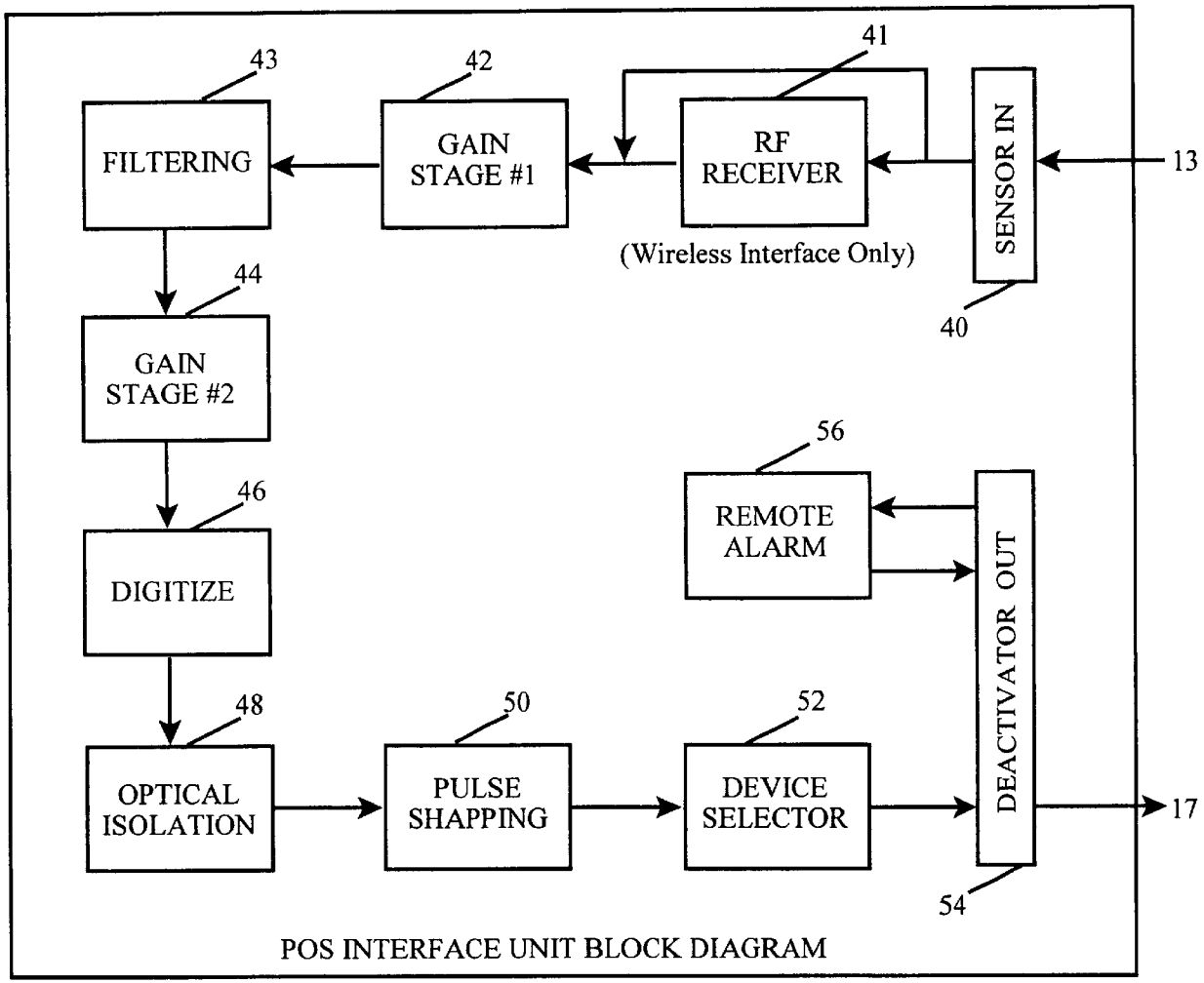
FIG. 5 is a block diagram of the POS interface unit.

Referring to FIG. 5, a detailed block diagram of the POS interface unit 10 is illustrated. POS interface unit 10 is preferably a flexible modular unit that can be easily modified to match the particular POS system and EAS system to be interfaced. The POS indicator sensor signal 13 is input at sensor input connector 40. If the link from the POS indicator sensor 12 is wireless, a wireless interface such as RF interface 41 is implemented. The sensor output signal 13 is then amplified at 42 and 44, filtered at 43, and digitized at 46. The sensor output signal 13 is isolated from the trigger signal 17, such as by optical isolation 48. The output signal is shaped at 50 for triggering the desired EAS tag deactivator. Because there are many different types of EAS tag deactivators available, the specific EAS tag deactivator is selected at 52, and the POS interface output or trigger signal 17 is appropriately directed to deactivator output connector 54. Examples of EAS tag deactivators include the deactivations of magnetoacoustic and magnetomechanical, RF, microwave, and harmonic EAS tags. Shaping at 50 and selection of connector 54 is selected according to a specific EAS tag deactivator. Upon triggering the EAS tag deactivator 18, a remote alarm 56 can be activated. The EAS tag deactivator remote alarm 56 can be used to indicate the EAS tag deactivator 18 has been activated, to indicate a fault, to indicate a power-on condition, and as a remote switch to disable the EAS tag deactivator 18.

Filter 43 is selectable depending upon the expected sensor output signal 13. Sensor output signal 13 may be a particular frequency, phase, or amplitude depending upon the sensor 12 that is selected. Filter 43 selectively discriminates the expected sensor output signal 13. The discrimination of the sensor output signal 13 is important to eliminate false triggering of the EAS deactivator. For example, referring back to FIG. 3, without filter 43 discriminating a specific sensor output signal 13 from microphone 36, any acoustic signal could be picked up by microphone 36 and result in a false triggering of EAS tag deactivator 18. Only a specific sensor output signal 13 will be passed through filter 43 to be used to trigger EAS tag deactivator 18.

Filter 43 can be implemented in hardware and/or software, and is modular and programmable in a manner that facilitates easy selectivity between a plurality of different possible sensor output signals 13. Amplifiers 42 and 44 are tailored according to filter 43, sensor output signal 13, and digitizer 46.

The present invention can be adapted to operate with other types of POS devices including those with handheld readers. It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A system to non-invasively interface a point-of-sale reader to an electronic article surveillance tag deactivator, comprising:

means for reading indicia associated with a product and generating a first signal indicating a successfull read of the indicia;

means for sensing said first signal disposed within a preselected distance of said reading means, said sensing means generating a second signal upon sensing said first signal, said means for sensing and said second signal being electrically separate from said first signal; and, means for deactivating an electronic article surveillance tag, said deactivating means being triggered by said second signal.

2. The system of claim 1 wherein said first signal is audible and said sensing means is a microphone.

3. The system of claim 1 wherein said first signal is optical and said sensing means is an optical sensor.

4. The system of claim 1 wherein said first signal is vibration and said sensing means is a vibration sensor.

5. The system of claim 1 wherein said means for reading indicia is a bar code reader.

6. The system of claim 1 wherein said sensing means includes means for filtering to selectively discriminate said first signal from a plurality of signals, said sensing means generating said second signal only in response to discriminating said first signal.

7. The system of claim 6 wherein said deactivating means further includes means for shaping said second signal for triggering a preselected deactivator means for deactivating a preselected type of electronic article surveillance tag.

8. A method to non-invasively interface a point-of-sale reader to an electronic article surveillance tag deactivator, comprising the steps of:

reading indicia associated with a product and generating a first signal;

non-invasively sensing said first signal and generating a second signal, wherein said first signal is electrically separate from said sensing and said second signal; and, receiving said second signal and deactivating an electronic article surveillance tag.

9. The method of claim 8 wherein the sensing step includes discriminating said first signal from a plurality of signals and generating said second signal only in response to discriminating said first signal.

10. The method of claim 9 wherein the step of generating a second signal includes shaping said second signal for deactivating a preselected type of electronic article surveillance tag.

* * * * *

UNITED STATES PATENT AND TRADEMARK OFFICE

CERTIFICATE OF CORRECTION

PATENT NO. : 6,281,796 B1
DATED : August 28, 2001
INVENTOR(S) : Canipe et al.

It is certified that error appears in the above-identified patent and that said Letters Patent is hereby corrected as shown below:

Title page,
Item [54], replace "POINT-OF SALE" with -- POINT-OF-SALE --.

Column 3,
Line 42, replace "successfull" with -- successful --.

Column 4,
Line 57, replace "successfull" with -- successful --.

Signed and Sealed this

Twenty-sixth Day of February, 2002

*Attest:*

*Attesting Officer*

JAMES E. ROGAN
*Director of the United States Patent and Trademark Office*